US005433443A

United States Patent [19]

Ples

[11] Patent Number: 5,433,443

[45] Date of Patent: Jul. 18, 1995

[54] TABLE HOCKEY GAME

[75] Inventor: Anthony P. S. Ples, Brampton, Canada

[73] Assignee: William Keith Schell, Bramalea, Canada

[21] Appl. No.: 264,717

[22] Filed: Jun. 23, 1994

[51] Int. Cl.[6] ..... A63F 7/06

[52] U.S. Cl. ..... 273/85 B; 273/85 F; 273/119 R; 273/129 W

[58] Field of Search ..... 273/85 R, 85 A, 85 B, 273/85 E, 85 F, 129 R, 129 W, 57.2, 126 R, 119 R; D21/20, 27, 17, 18

[56] References Cited

U.S. PATENT DOCUMENTS

| | | | |
|---|---|---|---|
| 2,150,515 | 3/1939 | Meyer | 273/85 A |
| 3,202,427 | 8/1965 | Patent et al. . | |
| 3,756,603 | 9/1973 | Goldfard | 273/129 W |
| 3,810,622 | 5/1974 | Payne | 273/85 A |
| 3,913,918 | 10/1975 | Trachtman . | |
| 4,076,242 | 2/1978 | Joseph | 273/85 B |
| 4,105,210 | 8/1978 | Jones et al. . | |
| 4,346,884 | 8/1982 | Warehime . | |
| 4,585,235 | 4/1986 | Williams | 273/129 W |
| 4,998,729 | 3/1991 | Lischerelli | 273/119 R |
| 5,242,164 | 9/1993 | Nicoll . | |

FOREIGN PATENT DOCUMENTS

| | | | |
|---|---|---|---|
| 1354075 | 1/1964 | France | 273/85 B |
| 1380734 | 10/1964 | France | 273/85 A |
| 3046136 | 7/1982 | Germany . | |
| 3903862A | 9/1989 | Germany . | |
| 588859 | 2/1959 | Italy | 273/85 F |
| 6608129 | 12/1967 | Netherlands | 273/85 B |
| 201400 | 8/1923 | United Kingdom | 273/85 B |
| 507871 | 6/1939 | United Kingdom | 273/129 R |
| 893003 | 4/1962 | United Kingdom | 273/85 B |

*Primary Examiner*—Sebastiano Passaniti
*Attorney, Agent, or Firm*—Bliss McGlynn

[57] ABSTRACT

A game apparatus for a simulated hockey game including a game board having a playing surface and at least two pairs of opposing sides with each side having an opening for receiving a small object such as a disk. There are four sets of game playing menders which are able to manipulate the object over the playing surface. Because there are four sets, four persons are able to play this game. A vertical shaft extends from each playing member and down through the playing surface. A number of generally horizontal rods are used to move the playing members along respective slots formed in the playing surface. Each rod is operatively connected to a respective one of the vertical shafts so that rotation of the rod causes rotation off the shaft and the attached playing member. At least some of the rods for moving the playing members of each of the sets project from a respective one of the four opposing sides. Thus, one person can be positioned at a respective one of the opposing sides and is able to play a respective one of the four sets. In a preferred embodiment, each of the four sets consists of four playing members, one of these being a goalie.

19 Claims, 3 Drawing Sheets

TABLE HOCKEY GAME

BACKGROUND OF THE INVENTION

This invention relates generally to table top games which simulate a sport such as hockey.

A wide variety of table top action games are known and many of these simulate a sport such as hockey or soccer. In a well known table top hockey game having a generally planar and rectangular playing surface and a side wall extending about the perimeter of this playing surface, there are two sets of playing members which can manipulate a movable object such as a simulated puck over the playing surface. A number of horizontal rods are used to move these playing members along respective slots formed in the playing surface. Either a gear mechanism or a bent spring mechanism is used to operatively connect each of these rods to a respective vertical shaft that extends downwardly through a slot from a playing member. Rotation of the rod about its longitudinal axis will cause rotation of the connected shaft and the playing member. Although this known game is well liked and has been used for many years, it has one substantial limitation in that it can only be played by two persons. In addition to the fact that there are only two teams of playing members on the board, the rods that manipulate these two teams only project from the two opposite ends of the game apparatus. Because of the Close proximity of these rods at each end and the location of same, the known tabletop hockey game would be difficult for more than two persons to use, even if more than two persons attempted to play the game.

U.S. Pat. No. 3,202,427 issued Aug. 24, 1965 to Chris Patent et al, teaches a hockey type board game with a flat playing surface bordered by eight equal edges and an upstanding peripheral wall. Every other wall has a single goal slot formed therein. Unlike the usual tabletop hockey game, the playing surface has four upwardly projecting deflectors, each of which is aligned between the center of the playing surface and the respective goal slot. This game does not come with movable playing members, particularly ones that can be moved by means of slidable rods. In this known game the puck is manipulated by means of a stick shaped like a hockey stick.

More recent U.S. Pat. No. 3,913,918 issued Oct. 21, 1975 to A. Tractman describes a board game which has a six sided game board which is played with a plurality of pucks and striking sticks. A retaining rim extends around the playing surface and formed in alternate sides of this rim are openings which are centrally located in their respective sides. This game requires the use of a number of starting spots on the board surface on which are disposed a plurality of pucks at the start of the game.

It is an object of the present invention to provide a game apparatus with a game board playing surface wherein there are four sets of game playing members able to manipulate a movable object such as a puck and wherein the playing members are movable by means of rotatable rods.

It is a further object of the present invention to provide a tabletop game involving a game board and movable playing members operated by rods, which game can be played by four persons, each of whom operates his or her own set of playing members.

SUMMARY OF THE INVENTION

According to one aspect of the invention, a game apparatus comprises a game board having a playing surface and two pairs of opposing sides with each side having an opening for receiving a small movable object. There are four sets of playing members adapted to manipulate the object over the playing surface. The four sets constitute four teams that are visually distinguishable from one another. One of the playing members in each set is a goalie member positioned in front of one of the openings for receiving the object and is movable sideways across the front of the opening. A vertical shaft extends from each of the playing members and down through the playing surface. A number of substantially horizontal rods are provided for moving the playing members along respective slots formed in the playing surface. These rods are axially movable in a generally horizontal direction in order to move the playing members. There are also means for operatively connecting each rod to a respective vertical shaft so that rotation of the rod about its longitudinal axis causes rotation of the connected shaft. At least some of the horizontal rods for moving the playing members of each set project from a respective one of the four opposing sides whereby a game can be played by four persons each positioned at one of the opposing sides and playing a respective one of the four sets.

In a preferred embodiment of the game apparatus, each of the four sets consists of four playing members.

According to another aspect of the invention, a table game apparatus for four players includes a game board having a generally planar playing surface and sidewalls extending around this playing surface. Four goals are distributed evenly around the perimeter of the playing surface. Four sets of four playing members only each capable of propelling a projectile across a playing surface are provided. Each playing member has its own vertical shaft extending down through a slot in the playing surface. Each of the sets constitutes a team that is visually distinguishable from the other three teams. One of the playing members in each set is a goalie member positioned in front of one of the goals and movable sideways across the front of the goal. A number of axially movable and rotatable rods extend generally parallel to the playing surface and are capable of moving the playing members along their respective slots. There is a mechanism for operatively connecting each rod to its respective vertical shaft so that rotation of the rod about its longitudinal axis causes rotation of the shaft.

Preferably, the table game includes the projectile which is dimensioned to pass into any of the goals and is in the form of a disk simulative of a hockey puck.

Further features and advantages will become apparent from the following detailed description taken in conjunction with the accompanying drawings.

DETAILED DESCRIPTION OF PREFERRED EMBODIMENT

Figure 1:
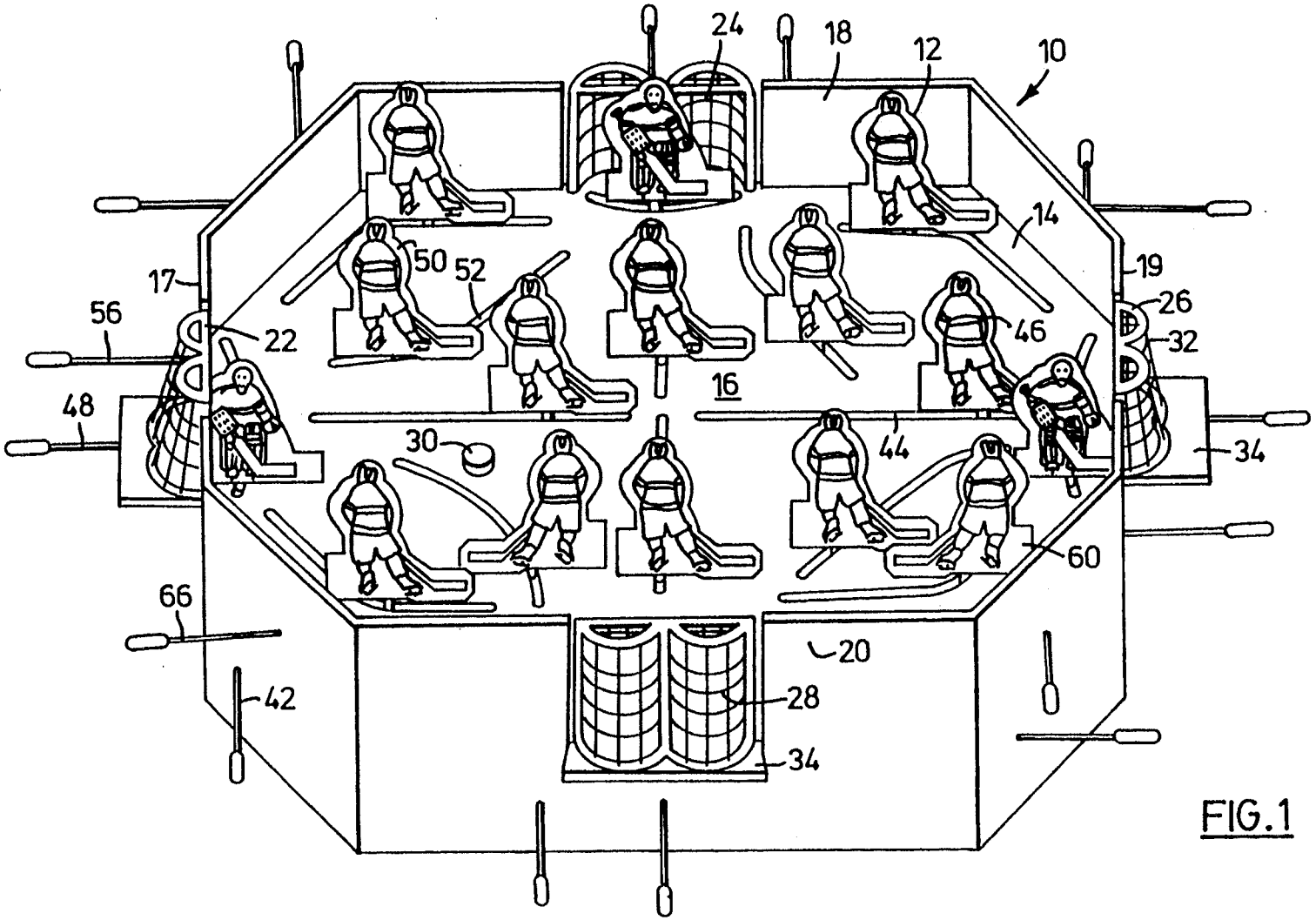
FIG. 1 is a schematic illustration, in perspective, showing the playing surface and vertical sides of a game apparatus constructed in accordance with the invention.

There is shown in FIG. 1 a game apparatus 10 constructed in accordance with the invention. The illustrated apparatus is designed to simulate a four way game involving four teams of playing members 12. The game apparatus includes a game board 14 which, in a known manner, can be made of plastic sheet material or fibreboard. The game board forms a playing surface 16 which has two pairs of opposing sides indicated at 17 to 20 with each of these sides having an opening 22 to 28 for receiving a small movable object such as a disk simulating a puck 30. As illustrated, each of the openings 22 to 28 is defined by a simulated hockey net structure 32 having its bottom end located in the plane of the playing surface 16. In one preferred embodiment, the hockey net structure is connected to the adjacent side walls on each side thereof and projects outwardly from the adjacent sidewall. The hockey net structure is supported at the bottom by means of an outwardly extending platform 34 which can be integrally connected to the adjacent sidewall or attached by means of a suitable connecting flange (not shown) and screws or bolts. It will be understood that the disk or puck 30 is dimensioned to pass into any of the goal net structures 32. A goal is scored by a player of the game by getting the puck 30 past the goalie of an opposing team and into the opening and net structure.

Figure 2:
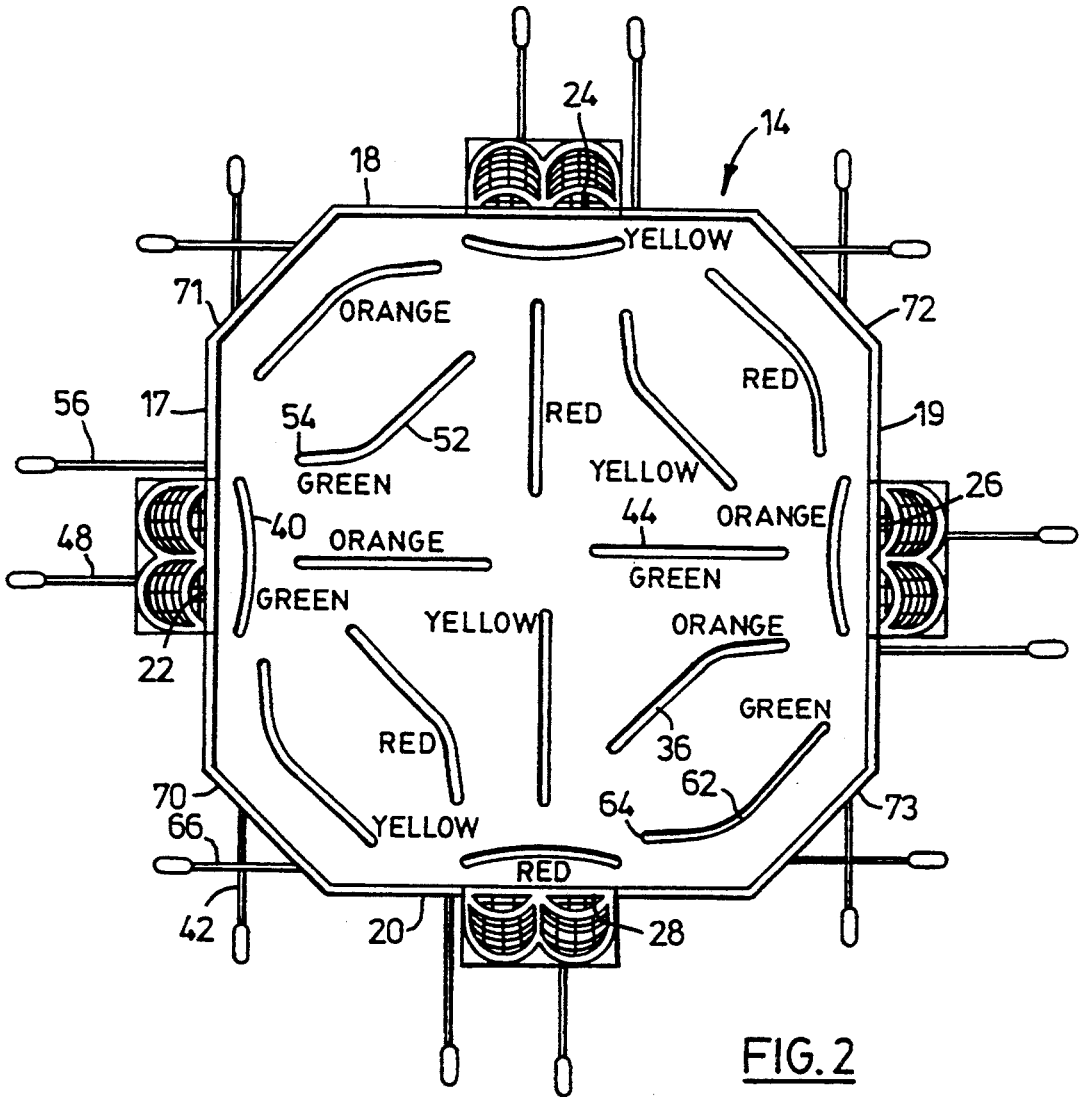
FIG. 2 is a plan view of the game apparatus of FIG. 1 without the playing members in order to illustrate clearly the slot arrangement.

The game apparatus includes four sets of game playing members 12 and these sets are preferably coloured differently so that each set can be clearly distinguished. Each colour represents a different team of playing members. In the preferred embodiment of the game apparatus there are four playing members in each set or team. In a known fashion, each playing member moves along its own slot indicated generally by reference 36. FIG. 2 illustrates the preferred arrangement of the slots 36 of which there are sixteen in the illustrated apparatus.

The slot arrangement for each of the four players on each team will now be described with reference to FIG. 2. It will be understood that the four slots 36 for each team are arranged in essentially the same manner and therefore it will only be necessary herein to describe the slot arrangement for one four man team. To assist in the identification of the slots provided for each team, the slots in FIG. 2 have been labelled using four different colours, namely yellow, orange, red and green. In an actual game apparatus the playing members 12 can be coloured these four different colours or any other four colours provided they can be readily distinguished from one another.

To take one of the colours as an example, the four green slots include a slot identified by reference 40 for one playing member which is a goalie member positioned in front of the opening or goal 22 for the green team. It will be understood that the goalie member is movable sideways across the front of the opening 22 along the slot 40 which forms a slight convex curve directed towards the centre of the board. Preferably the slot 40 extends substantially the entire width of the opening 22 in order that the goalie member can provide effective protection for the green team's goal. The green goalie member is operated by a rod 42 that projects outwardly from a corner of the game board located to the right of the opening 22.

A second playing member for the green team is slidable back and forth in a straight, elongate slot 44. This slot is directly in front of the opening 26 for the orange team. The slot 44 is arranged so that it is perpendicular to the adjacent side 19. It will be appreciated that the playing member moving in slot 44 is an offensive player for the green team and corresponds to the centre in a regular ice hockey team. The playing member 46 movable in the slot 44 is controlled and operated by a control rod 48 which projects outwardly from the sidewall 17. The second playing member 46 is slidable in a substantially straight line located between the green goal or opening 22, that is the goal for its team, and the goal positioned opposite the green goal. The slot or line 44 extends perpendicular to side walls adjacent both of these goals.

There is a third playing member for the green team located to the left of the opening or goal 22. This third playing member 50 is movable along a slot 52 which, in the illustrated embodiment, is gently curved to the left in a direction moving away from the green goal. The slot 52 extends from a point 54 close to the green opening 22 towards a central area of the board and then curves leftward toward the opening 24 on the left side of the green opening 22. The third player 50 is able to provide some defence for the green goal and is also able to be used offensively, particularly for scoring on the yellow goal 24. The third player 50 is operated by means of a control rod 56.

The fourth playing member 60 for the green team is located to the right of the opening 22 and is slidable in a slot 62. Unlike the slot 52, the slot 62 is spaced a substantial distance away from the green opening or goal 22. The slot 62 extends from a point 64 close to the opening or goal 28 located on the right side of the opening 22 towards the side 19 of the board, which side is opposite the opening 22. In the illustrated preferred embodiment, the slot 62 forms an obtuse angle and follows to some extent the adjacent sidewalls. Thus, the slot 62 is positioned generally between the red goal or opening 28 and the orange goal or opening 26. The playing member 60 is operated and controlled by a control rod 66.

As can be seen from FIGS. 1 and 2, in the illustrated preferred embodiment at least the horizontal control rods 48 and 56 for moving two of the green playing members project from the side 17 where the green goal is located. Thus, the person playing the green team positions himself at the side 17 where he can easily reach and manipulate the control rods 48 and 56. He is also easily able to reach the additional control rods 42 and 66 which operate the other two green playing members which project from a corner sidewall 70. There are three other corner side walls indicated at 71 to 73. It will thus be appreciated that a board game can be played using the apparatus 10 of the invention by four persons, each positioned at one of the four opposing sides 17, 18, 19 and 20 and playing a respective one of the four sets.

As clearly shown in FIG. 2, the preferred game board 14 is octagonal with the four shorter corner sidewalls 70 to 73 alternating with the four longer sides 17, 18, 19 and 20. The corner sidewalls 70 to 73 each extend at an angle of about 45 degrees to the longer sides adjacent thereto. The use of the octagonal shape has the advantage of permitting the indicated number of playing members to cover most of the playing surface 16 with their movement. Thus the octagonal shape helps to avoid "dead" areas where the puck 30 cannot be reached by any playing member 12.

Figure 3:
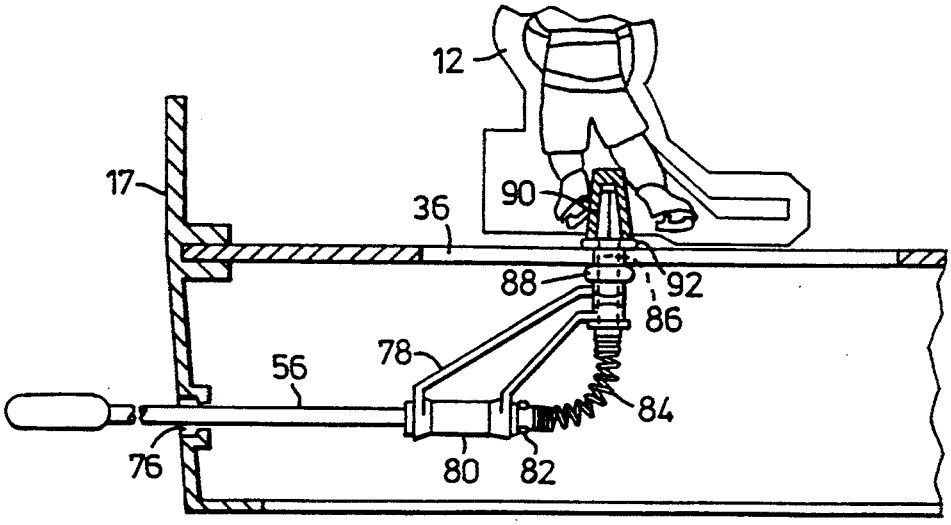
FIG. 3 is a cross-sectional elevation showing one form of connecting mechanism between the horizontal rod that is used to move a playing member and its vertical, rotating shaft.
Figure 4:
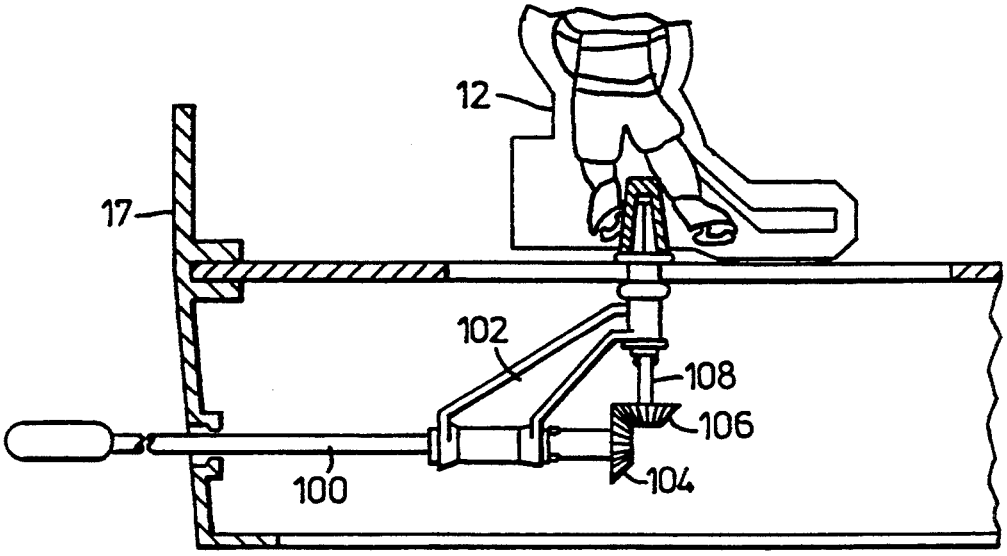
FIG. 4 is a cross-sectional elevation similar to FIG. 3 but showing an alternative form of connecting mechanism between the rod and the vertical shaft.

FIGS. 3 and 4 of the drawings illustrate two known mechanisms for operatively connecting a control rod such as rod 56 to its respective vertical shaft so that rotation of the rod about its longitudinal axis causes rotation of the connected shaft. In the version of FIG. 3, the rod 56 extends through an opening 76 in the sidewall 17 and is slidable in this opening. The inner end of the rod extends through a rod and shaft holder 78 which can be molded from plastic. The bottom end of this holder is formed into a sleeve section 80 through which the end of the rod extends. Small protuberances 82 are formed on the inner end of the rod to prevent the rod from being pulled out of the sleeve section 80. Attached to the inner end of the rod is a small coil spring 84 which is bent 90 degrees. One end of the spring 84 is attached to the bottom end of vertical shaft 86 which typically is a steel shaft. The shaft 86 is held in its vertical position by means of vertically extending sleeve section 88 which is an integral part of the holder. The shaft projects through the slot 36 in the game board and into a non-circular opening or aperture 90 formed by the bottom of the playing mender 12. The top of the shaft has a square or other non-circular cross-section so that it does not rotate in the opening 90. Thus rotation of the shaft about its axis causes a corresponding rotation of the playing member. The holder 78 is formed with short arms 92 that project across the slot 36 and act to hold the holder 78 in position as it is moved back and forth along the slot. The rod must of course be of sufficient length to permit it to slide its respective playing member along the full length of the slot.

In the embodiment shown in FIG. 4 there is a control rod 100 which extends through a holder 102 which can be constructed in substantially the same manner as the holder 78 of FIG. 3. On the inner end of the rod 100 is a small bevelled gear 104 which engages another bevelled gear 106 mounted on vertically extending shaft 108. Thus, rotation the rod 100 about its longitudinal axis will cause a corresponding rotation of the shaft 108 and the playing member 12. Except for the substitution of the two bevelled gears in place of the coil spring, the playing member 12 of FIG. 4 and the mechanism for connecting same to the control rod can be the same as that shown in FIG. 3 and described above.

In one preferred embodiment of the game, the game board 14 has a width in each direction of about $23\frac{1}{4}$ inches to the outside of the side walls. The playing members 12, except for the goalie member, have a height of about $2\frac{5}{8}$ inches and a total width of $2\frac{5}{8}$ inches. The goalie member can be slightly smaller measuring $2\frac{1}{4}$ inches by $2\frac{1}{4}$ inches.

The game can be played with the apparatus 10 of the invention using the following rules:

(1) Any of the four players may score on the goal of any of the other players and in some cases he may score accidently on himself.

(2) The number of goals scored in any particular goal is recorded. If desired, each player may be allowed to keep track of the goals scored against his particular team.

(3) The game is over when one team has had ten goals scored against it.

(4) When the game is over, the goals scored in each of the four goal nets are added up and the team or player which has the fewest goals scored against it or him is the winner.

As in the usual hockey game, at the start of the game or after any goal has been scored, the puck 30 is dropped at the centre of the game board where it can be reached by a player from each of the four teams.

It will be readily apparent that various modifications and changes can be made to the illustrated game apparatus without departing from the spirit and scope of this invention. For example, the various slots in the game board 14 can be arranged in a somewhat different fashion than that illustrated in FIG. 2. It is also possible to have additional playing members for each of the four teams. All such modifications and changes as fall within the scope of the appended claims are intended to be part of this invention.

I therefore claim:

1. A game apparatus comprising:

a game board having a playing surface and two pairs of opposing sides with each side having an opening for receiving a small movable object;

four sets of game playing members adapted to manipulate said movable object over said playing surface, said four sets constituting four terms that are visually distinguishable from each other;

one of the playing members in each set being a goalie member positioned in front of one of the openings for receiving said object and movable sideways across the front of the opening;

a vertical shaft extending from each of said playing members and down through said playing surface;

a number of substantially horizontal rods provided for moving said playing members along respective slots formed in said playing surface, said rods being axially movable in a generally horizontal direction in order to move said playing members; and means for operatively connecting each rod to a respective vertical shaft so that rotation of the rod about its longitudinal axis causes rotation of the connected shaft;

wherein at least some of said horizontal rods for moving the playing members of each of said sets project horizontally from a respective one of the four opposing sides whereby a game can be played by four persons each positioned at one of said opposing sides and playing a respective one of the four sets.

2. A game apparatus according to claim 1 wherein each of said four sets consists of four playing members.

3. A game apparatus according to claim 1 wherein said opening in each side is defined by a simulated hockey net structure having its bottom end at the playing surface.

4. A game apparatus according to claim 2 wherein one of the four playing members in each set is slidable back and forth directly in front of one of the object receiving openings, this one opening being a goal for an opposing set of playing members, and wherein the direction of sliding movement of said one playing member is perpendicular to the adjacent side of the playing surface having said one opening therein.

5. A game apparatus according to claim 2 wherein said game board is octagonal with four shorter sides alternating with the four sides that comprise said two pairs of opposing sides, said shorter sides each extending at an angle of about 45 degrees to the longer sides adjacent thereto.

6. A game apparatus according to claim 1 wherein each set of game playing members includes a first playing member located to the left of one of the openings, said one opening being a goal structure for that set of playing members and wherein said first playing member is movable along a first slot that extends from a point close to said one opening towards a central area of the board and then curves leftward towards the opening on the left side of said one opening.

7. A game apparatus according to claim 6 wherein each set of game playing members includes a second playing member located to the right of said one opening but spaced a substantial distance away from said one opening, and wherein said second playing member is movable along a second slot that extends from a point close to the opening on the right side of said one opening towards the side of the board opposite said one opening, said second slot being bent so as to form an obtuse angle.

8. A game apparatus according to claim 7 wherein each of said four sets consists of four playing members including said goalie member.

9. A table game apparatus for four players comprising:

a game board including a generally planar playing surface and side walls extending around said playing surface;

four goals distributed evenly around the perimeter of said playing surface;

four sets of four playing members only each capable of propelling a projectile across said playing surface and each playing member having its own vertical shaft extending down through a slot in said playing surface, said four sets constituting four terms that are visually distinguishable from each other;

one of the playing members in each set being a goalie member positioned in front of one of the goals and movable sideways across the front of the goal;

a number of axially movable and rotatable rods extending generally parallel to said playing surface and capable of moving said playing members along their respective slots; and means for operatively connecting each rod to a respective vertical shaft so that rotation of the rod about its longitudinal axis causes rotation of the shaft connected thereto.

10. A table game according to claim 9 including said projectile which is dimensioned to pass into any of said goals and is in the form of a disk simulative of a hockey puck.

11. A table game according to claim 10 wherein said game board is octagonal and the four goals are located in the center of four respective sidewalls.

12. A table game according to claim 11 wherein each set is colored differently than the other sets.

13. A table game according to claim 11 wherein a second playing member in each team is slidable in a substantially straight line located between a first goal for its team and a second goal positioned opposite said first goal, said line extending perpendicular to the sidewalls adjacent said first and second goals.

14. A table game according to claim 13 wherein said rod connecting means comprise bent coil springs extending from the inner ends of said rods to respective vertical shafts of the playing members.

15. A table game according to claim 13 wherein a third playing member in each team is positioned generally between said first goal for its team and a third goal located on the left hand side of said first goal while a fourth playing member in each team is positioned generally between a fourth goal, located on the righthand side of said first goal, and said second goal.

16. A table game according to claim 13 wherein said game board is octagonal and the four goals are located in the center of four respective sidewalls.

17. A table game according to claim 15 wherein each of said goals comprises a simulated hockey net structure which is connected to an adjacent sidewall on each side thereof and which projects outwardly from said adjacent sidewall.

18. A table game apparatus according to claim 9 wherein said game board has two pairs of opposing side walls and one of said goals is arranged in each of these opposing side walls, each of said opposing side walls having the same length.

19. A table hockey apparatus comprising:

a game board having a generally flat playing surface and two pairs of opposing sides with each side having a goal opening for receiving a small movable object;

four sets of movable game playing members forming four teams that are visually distinguishable from one another;

each set of game playing members comprising a goalie member positioned in front of one of the openings and at least three additional members adapted to manipulate said movable object over said playing surface;

a vertical shaft extending at least from each of said additional members and down through said playing surface;

a number of substantially horizontal rods provided for moving said additional playing members along respective slots formed in said playing surface, said rods being axially movable and rotatable;

means for operatively connecting each rod to a respective vertical shaft so that rotation of the rod about its longitudinal axis causes rotation of the connected shaft;

wherein at least some of said horizontal rods for moving the playing members of each of said sets project horizontally from a respective one of the four opposing sides whereby a game can be played by four persons each positioned at one of said opposing sides and playing a respective one of the four sets.

* * * * *